United States Patent [19]

O'Brian

[11] Patent Number: 4,927,128

[45] Date of Patent: May 22, 1990

[54] SLIDING LEG BODYWORK TABLE

[76] Inventor: Lynwood O'Brian, 5381 Old San Jose Rd., Soquel, Calif. 95073

[21] Appl. No.: 404,852

[22] Filed: Sep. 8, 1989

[51] Int. Cl.[5] ..... A61G 13/00

[52] U.S. Cl. ..... 269/322; 269/901; 108/36

[58] Field of Search ..... 269/901, 322, 327, 328; 128/70–74; 108/35–36, 113, 130–132

[56] References Cited

U.S. PATENT DOCUMENTS

| | | | |
|---|---|---|---|
| 2,326,461 | 10/1943 | Howe | 108/36 |
| 2,618,524 | 11/1952 | Hoffmann | 108/36 |
| 2,747,957 | 5/1956 | Lencioni | 108/36 |
| 3,291,078 | 12/1966 | De Saussure | 108/36 |
| 3,878,797 | 4/1975 | Patterson | 108/36 |
| 4,143,601 | 3/1979 | Pike | 108/35 |
| 4,333,638 | 6/1982 | Gillotti | 269/901 |

*Primary Examiner*—Robert C. Watson
*Attorney, Agent, or Firm*—Jeffrey A. Hall

[57] ABSTRACT

A sliding leg bodywork table consisting of a top rectangular surface divided into two abutting sections hingedly attached to each other and foldable to a parallel position. Two pairs of adjustable height legs are slidably attached at opposite ends of the table surface, the legs foldable into the table surface's housing. A channel system provides support and positioning function for the table legs and rotatable diagonal braces extend from a cross tube for connecting each leg pair to the table surface. Handles are provided for ease of transport. A system of wire ropes for supporting the central hinged end of table top sections in conjunction with said diagonal braces and for positive locking of the paired legs in operational position is included.

10 Claims, 2 Drawing Sheets

SLIDING LEG BODYWORK TABLE

BACKGROUND OF THE INVENTION

1. Field of the Invention

This invention relates to message and therapeutic bodywork tables, especially to bodywork tables for use in physical therapy, massage, or other related bodywork activities.

2. Description of Prior Art

Many, if not most health practitioners in the field of massage and other therapeutic bodywork, prefer to use a massage and therapeutic bodywork table that provides a strong working surface, is lightweight, adjustable, and easy to set up and break down for storage.

Heretofore a wide variety of tables have been proposed and implemented for massage and therapeutic bodywork.

U.S. Pat. No. 4,333,638 to Gillotti discloses a table with a truss suspension system having legs hinge from the ends of the table and diagonal braces extending from the center of the table to attach onto the table legs. The truss system comprised of a cord member of wire rope or flexible material attached to the lower end of the legs and extending the full length of the table parallel to the table surface. Users regarded this type of table as unsatisfactory because the position of the cable interfered with the movements of the user and required the user to connect and disconnect the diagonal braces on one or both ends on setting up or collapsing the table.

Another type of folding table is disclosed in U.S. Pat. No. 3,357,729 to Krueger, comprised a collapsible table with strap-like brace members having folding legs at each end. This type of table did not have a support cable system attached to the legs, not did it provide a strong working platform, and tended to be noisy when rocking forces were applied thereto. Also, this type of table required some skill or training on the part of its users to set up and collapse, and provided limited means to adjust height dimensions of the working surface.

A still different approach to folding support structures is seen in U.S. Pat. No. 2,326,461 to Howe. This table considered of a plurality of braces hinged to support legs, and foldable into a carrying case. This support structure relates to tables where the act of folding together the hinged top portions causes collapsing or folding of the support legs. This table was not adjustable, stable, not suitable for bodywork application. Most users, therefore, would find it desirable to have a bodywork table that provides a strong working platform that is quiet even when rocking forces are applied, adjustable, lightweight, easy to set up, collapse, and store.

SUMMARY OF THE INVENTION

Accordingly, I claim the following as objects and advantages of the invention: to provide a table for massage and other therapeutic bodywork activities that is simple in design, and lightweight, yet provides a strong working platform, to provide a table that is easily and reliably set up for work or collapsed for transport and storage, to provide such a table that may be adjusted to various heights with ease, and to provide such a table that is quiet even when rocking forces are applied.

In addition I claim the following additional objects and advantages: to provide a bodywork table with legs pairs spaced at a slight angle to one another so that the legs rest not perpendicular to the floor (or other surface) but spaced at a slight angle with a greater distance between the lower portions of the legs than between the upper portion thereof, to provide a table that may utilize welded aluminum for legs and braces to provide consistent strength and quality to the product, to provide such a table where the braces are permanently fixed at both ends and therefore require no locking or unlocking action when the table is set up or collapsed, to provide such a table whose design allows the top sections of the legs to slide inward towards the center of the table allowing the weight placed on table to be supported within a shorter span, to provide such a table having a transversely connected tube secured to this underside of the table to provide a stronger working platform, to provide such a table having a plurality of channels situated within the frame ends for securing and facilitating the positioning of the table legs, and to provide such a table with a design that facilitates manufacture and assembly.

DRAWING REFERENCE NUMERALS

Figure 1:
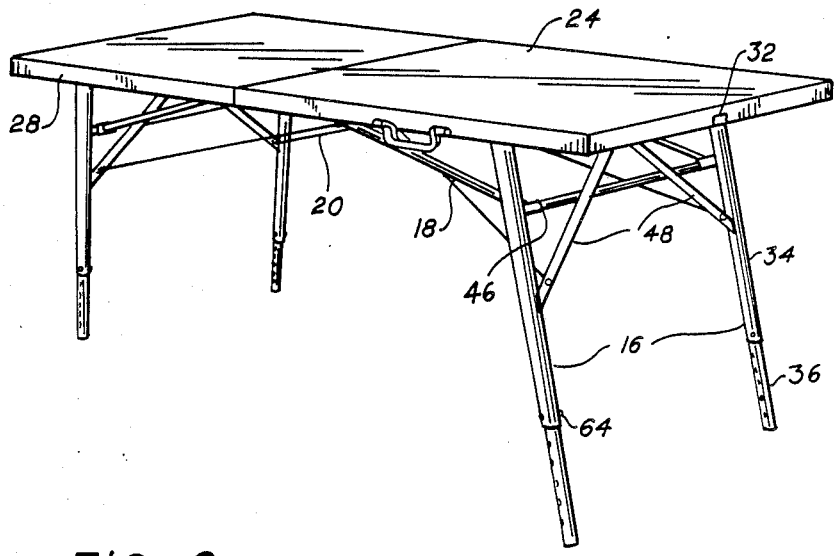
FIG. 1 shows a perspective view of a sliding leg bodywork table according to the invention.

14 hinges
16 paired leg set
18 diagonal brace set
20 wire rope
22 channels
24 platform
26 platform halves
28 perimeter frame
30 skin
32 latch
34 upper leg tube
36 lower leg tube
37 lower leg hole
38 upper leg adjustment hole
40 tube cap
42 leg set top tube
44 lower connecting cross tube
46 diagonal brace/leg set connecting point
48 braces
50 diagonal brace connecting tube
54 brushing tube
58 rounded channel end
64 leg height adjustment pin
66 handle

DETAILED DESCRIPTION OF A PREFERRED EMBODIMENT

FIG. 1 shows a bodywork table according to the preferred embodiment of the invention. The table comprises a table top composed of two abutting platform halves 26 hingedly secured in a central position, two sets of paired legs 16, two sets of diagonal braces 18 attached at one end to legs 16 at a connecting point 46 and at the other end to a diagonal brace connecting tube 50, four wire ropes 20, and four channels 22 within the frame ends for securing and adjusting the leg sets 16 to the platform 24.

The top surface platform 24 is composed of two abutting halves 26 secured together with a center hinge 14. The platform halves are made with a perimeter frame 28 covered with a rigid surface element or skin 30. Each section of said platform is covered with cushioning, upholstery, or similar material. Latches 32 are used on opposite ends from said hinge 14 to secure the table when folded. In another embodiment an internal latch is provided in conjunction with handle 66.

Two sets of paired legs 16 support the table top platform 24. Legs 16 are composed of two upper leg tubes 34 and two lower leg tubes 36. The lower leg tubes 36 are slightly smaller in diameter than the upper leg tubes 34 and are slidably engaged within the upper leg tubes. A hole 38 in the upper leg portion is matched with one of a pluraity of holes in the lower leg. This allows for adjusting the height of the table, from a position of full extension of the legs 34 and 36 to a position where the lower leg 36 is slid entirely within the upper leg tube 34. The lower leg tube is fitted with a tube cap 40 for suitable floor contact. A top tube 42 connects the upper legs together at their top ends. Tube 42 extends slightly past the legs for connection to the frame 28. A lower connecting cross tube 44 is fitted between the legs and located substantially parallel to the top tube 42. This lower connecting tube 44 is an attachment point for diagonal supports 46. The leg sets 16 are strengthened with two braces 48 to which wire ropes 20 are secured by conventional U-bolts. For stability the leg pairs are not precisely parallel with each other but positioned so that the distance between them is greater at their lower portions than at their upper portions.

Diagonal braces 18 are paired sets that connect substantially at a central position on the table at one end and at the other end to leg sets 16. Braces 18 are joined with a substantially perpendicular connecting tube 50 at the center of the table. Connecting tube 50 is secured to the inside of the frame with conventional blocks which allows tube 50 to rotate as necessary. Braces 18 and connecting tube 50 provide additional support functions in the central area of the table platform. The brushing tube 54 is fitted to diagonal brace 18 and is rotably engaged to connecting tube 44 as shown in FIG. 4 allowing for a strong yet simple connection between the legs and diagonal braces.

Figure 4:
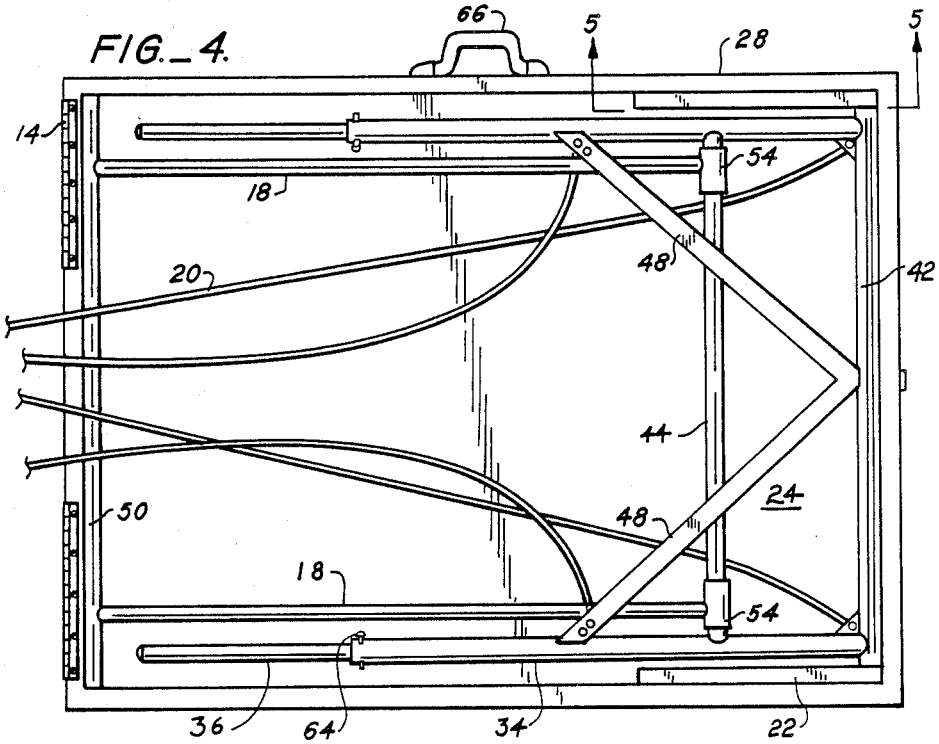
FIG. 4 shows a perspective view of the undersurface of the table showing legs and braces in storage position.
Figure 5:
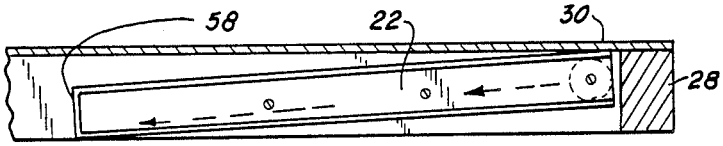
FIG. 5 shows a blowup of a channel.

The four wire ropes 20 are secured at one end to the leg set top tube 42 near the channels 22 and diagonally traverse the table to a connecting point on brace 48 as shown in FIG. 4.

A plurality of channels 22 are secured within the platform frame to accommodate the ends of the leg set top tubes 42. In the preferred embodiment four such channels are provided. The channels 22 facilitate the transfer of weight and lateral forces from the table top to the legs and provide a sliding action guide facilitating movement of the leg sets. A inner end of each channel provides a positive stop for the leg set top tube 42.

Operation

In use the bodywork table of FIG. 1 will perform a wide variety of support and bodywork facilitating functions, but users will find it most useful for massage and other therapeutic applications.

Figure 2:
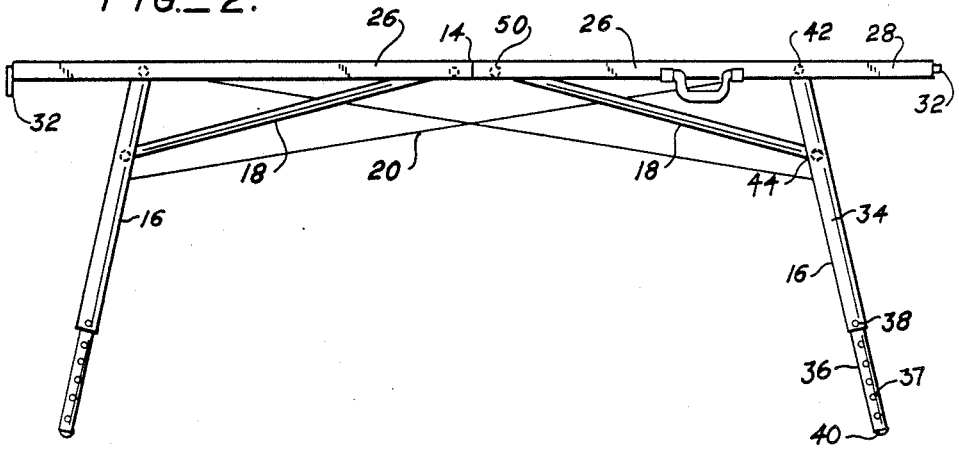
FIG. 2 shows a side view of such table.
Figure 3:
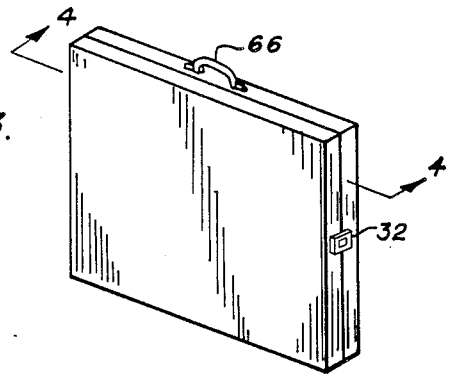
FIG. 3 shows a perspective view of such table in disassembled, transportable position.

The bodywork table has basically four modes of operation. The operational mode is when the table is opened, upright, and expanded as shown in FIG. 1 and FIG. 2. The storage or transport mode is when the table is folded as shown in FIG. 3. Functionally between these two operational modes are the opening and closing modes.

In the storage or transport mode the leg sets 16 and diagonal brace sets 18 are parallel to and inside of the frame of the table top sections. The two hingedly connected sections of the table top platform are folded together and secured with a latch 32.

In the opening mode the table is placed on its side with the handles upright. The latch is released and the two top sections are opened to 180 degrees. The leg sets are automatically opened by pulling forces applied to them by the four cables as the table top sections are opened. As the top sections reach the 180° open mode, the leg set top tube reaches the inside end of the channel and all four cables are taut.

Simultaneous with the legs sliding in the channel, the diagonal braces rotate at both ends creating a substantially triangular arrangement between the end legs, diagonal braces and table top platform. The same procedures are simultaneously performed with the other half of the table.

The table is then moved from its side to an upright position with all four legs contacting the floor. In this position the weight of the table top sections and any weight placed on the table add additional locking force to the leg set top tubes in the channel ends. Added weight tightens the cables 20 creating additional tension and strength.

The closing mode is performed by placing the table on its side and slightly closing both halves which relieves tension on the cables. The leg sets are pulled away from the channel ends and folded back into the table top frame. Both table top sections are then folded together and latched.

If the user chooses to adjust the length of the legs in order to alter the vertical height of the table from the ground, the table is placed on its side and the legs opened. Pin 64 is removed from the lower and upper leg tube and the lower leg tube is then free to move either further into the upper leg tube is shorten the overall length of the leg or the lower leg tube may be extended a greater distance out of the upper leg tube thereby lengthening the overall length of the leg. The upper and lower leg are then secured at the desired length by placing the pin 64 through matched holes on the upper and lower leg sections.

While the above description contains many specificities, the reader should not construe these as limitations on the scope of the invention, but merely as exemplifications of preferred embodiments thereof. Those skilled in the art will envision many possible variations within its scope. For example, skilled artisans will readily be able to change the dimensions and shapes of the various embodiments. They will also be able to make the table out of alternative materials such as wood, aluminum, or strengthened plastics or substitute other material for the wire ropes such as flexible resilient cords. They can make the table without a cable mechanism and make many variations on the leg adjustment mechanism. They can provide for variations on the shape of the channel and leg securing mechanism. For example, they could use two cables between opposing legs and provide a notch or other locking device in each channel for securing leg sets in the operational mode. In fact, they can provide any type of channel leg securing device for securing and adjusting the leg sets to the table frame.

Accordingly, the reader is requested to determine the scope of the invention by the appended claims and their legal equivalents, and not by the examples which have been given.

What is claimed is:

1. A folding portable table for use in massage and other therapeutic applications, comprising:

a rectangular table top comprised of a pair of abutting rectangular table top sections hingedly connected to one another, a perimeter frame integral with each of said table top sections, four channels, each channel being secured inside of said perimeter frame and in a corner position thereof, said channels being elongate and adapted to slidably receive and secure a table leg therein, two sets of paired tubular legs, each set connected together by a leg set top tube and a lower connecting cross tube being essentially parallel to said table top so that each pair of legs is secured to a underside of a table top section, each leg comprising an upper and a lower portion, said lower portion being of slightly smaller dimension than said upper portion to permit a telescoping movement by the lower portion.

means for securing said lower leg portion and said upper leg portion together, two sets of paired diagonal braces each secured at one end to the underside o a table top section substantially at a central position and at the other end each diagonal brace is rotably connected to said leg set connecting cross tube forming a triangular configuration between the support legs, the diagonal braces, and the table top, and four wire rope cables each attached at one end to said leg set top tube near each channel and at the other end to a brace, each cable being under tension when said table top sections are in an open configuration.

2. The folding portable table of claim 1 wherein the legs of the table are set having a distance between the upper portion of the legs greater than the distance between the bottom portion so that the leg pairs are set at a slight angle, and are not perpendicular to the floor.

3. The folding portable table of claim 1 wherein the legs are composed of aluminum.

4. The folding portable table of claim 1 wherein said means for securing the lower leg portion to the upper leg portion comprises a row of holes along said legs so that a hole on both leg portions may be matched and secured together by pin, screw, or other conventional mechanical joining device.

5. The folding portable table of claim 1 wherein said cables are attached each at one end to said leg set top tubes near each channel and at the other end to a lower point on sad leg brace, each cable being under tension when said table top sections are in an open configuration.

6. A sliding leg bodywork table for use in massage and other therapeutic applications, comprising:

a substantially rectangular table top comprised of a pair of abutting rectangular table top sections hingedly connected to one another, a perimeter frame attached to each of said table top sections, two sets of paired tubular legs, each set connected together by a leg set top tube and a parallel and lower connecting cross tube, each leg set top tube is slidably connected to the table top sections so that each pair of leg is secured to the underside of a table top section, each leg comprising an upper and a lower portion, said lower portion being of slightly smaller dimension than said upper portion to permit a telescoping movement by the lower portion, means for securing said lower leg portion and said upper leg portion together, four channels, each channel being secured inside of said perimeter frame on a side and a corner of said rectangular table top to provide a sliding means for positioning and securing the table legs, said channels being elongate and adapted to slidably receive and secure the table legs therein, two sets of paired diagonal braces each secured at one end to the underside of the table top section substantially at a central position and at the other end each diagonal brace is rotatably connected to said leg set connecting cross tube forming a substantially triangular configuration between the support legs, the diagonal braces, and the table top, and four wire rope cables each attached at one end to said leg set top tube near each channel and at the other end to a brace, each cable being under tension when said table top sections are in an open configuration.

7. The bodywork table defined by claim 6 wherein the legs of said table are set so that the distance between the upper portion of the legs is greater than the distance between the bottom portion so that the leg's pairs are set at a slight angle, and are not perpendicular to the floor.

8. The bodywork table defined by claim 7 wherein the legs are composed of welded aluminum.

9. The bodywork table defined by claim 6 wherein said means for securing the lower leg portion to the upper leg portion comprises a row of through holes along the length of said legs so that a hole on both leg portions may be matched and secured together by pin, screw, or other mechanical joining device.

10. The bodywork table defined by claim 6 wherein said cables are attached each at one end to said leg set top tube near each channel and at the other end to be opposing and diagonal leg set at a lower point on each leg, each cable being under tension when said sections are in the open configuration.

* * * * *